US006486905B2

(12) United States Patent
Suzuki et al.

(10) Patent No.: US 6,486,905 B2
(45) Date of Patent: Nov. 26, 2002

(54) IMAGE-FORMING SUBSTRATE AND IMAGE-FORMING SYSTEM USING SAME

(75) Inventors: Minoru Suzuki, Tochigi (JP); Hiroshi Orita, Saitama (JP); Hiroyuki Saito, Saitama (JP); Katsuyoshi Suzuki, Tokyo (JP); Koichi Furusawa, Tokyo (JP)

(73) Assignee: Asahi Kogaku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/080,541

(22) Filed: Feb. 25, 2002

(65) Prior Publication Data

US 2002/0089580 A1 Jul. 11, 2002

Related U.S. Application Data

(62) Division of application No. 09/221,574, filed on Dec. 29, 1998.

(30) Foreign Application Priority Data

Jan. 6, 1998 (JP) ..... 10-012134
Jan. 6, 1998 (JP) ..... 10-012135

(51) Int. Cl.[7] ..... B41J 2/44; B41J 2/435; B41M 5/28; B41M 5/34

(52) U.S. Cl. ..... 347/224; 347/172

(58) Field of Search ..... 347/171, 172, 347/224, 225, 232, 233; 430/138

(56) References Cited

U.S. PATENT DOCUMENTS

| | | | | |
|---|---|---|---|---|
| 4,399,209 A | | 8/1983 | Sanders et al. | |
| 4,644,376 A | | 2/1987 | Usami et al. | |
| 4,816,367 A | | 3/1989 | Sakojiri | |
| 4,916,042 A | | 4/1990 | Sakojiri | |
| 5,104,767 A | | 4/1992 | Nakamura | |
| 5,170,178 A | * | 12/1992 | Yokoyama | 347/224 |
| 5,198,321 A | | 3/1993 | Hosoi et al. | |
| 5,329,300 A | * | 7/1994 | Nishiyama | 347/224 |
| 5,409,797 A | | 4/1995 | Hosoi et al. | |
| 5,494,772 A | | 2/1996 | Hosoi et al. | |
| 5,645,920 A | | 7/1997 | Nishiyama | |
| 5,726,700 A | * | 3/1998 | Imai | 347/224 |
| 6,139,914 A | | 10/2000 | Suzuki et al. | |
| 6,145,976 A | | 11/2000 | Suzuki et al. | |
| 6,161,971 A | | 12/2000 | Suzuki et al. | |
| 6,243,161 B1 | | 6/2001 | Suzuki et al. | |

FOREIGN PATENT DOCUMENTS

| | | | | |
|---|---|---|---|---|
| DE | 3730842 A1 * | 3/1989 | | B41M/5/26 |
| EP | 0338025 B1 * | 5/1992 | | B41M/5/26 |
| JP | 61137787 | 6/1986 | | |
| JP | 4-4960 | 1/1992 | | |

* cited by examiner

*Primary Examiner*—Huan Tran
(74) *Attorney, Agent, or Firm*—Greenblum & Bernstein, P.L.C.

(57) ABSTRACT

An image-forming system has an image-forming sheet, and a printer for forming an image on the sheet. The sheet has a sheet of paper, and a layer of microcapsule, coated over the paper sheet, that contains a plurality of microcapsules filled with a dye. A shell wall of each microcapsule is composed of a resin exhibiting a pressure/temperature characteristic such that, when each microcapsule is squashed under a predetermined pressure at a predetermined temperature, the dye seeps from the squashed microcapsule. The microcapsules are covered with an infrared absorbent coating that-absorbs infrared rays having a specific wavelength. The printer has a transparent glass plate, and a roller platen elastically pressed against the plate at the predetermined pressure, with the sheet being interposed between the plate and the platen. Further, the printer has an optical scanner for scanning the layer of microcapsules with an infrared beam having the specific wavelength, such that the microcapsules, irradiated by the infrared beam, are heated to the predetermined temperature.

4 Claims, 8 Drawing Sheets

IMAGE-FORMING SUBSTRATE AND IMAGE-FORMING SYSTEM USING SAME

This is a divisional of U.S. application Ser. No. 09/221,574, filed Dec. 29, 1998, the contents of which are expressly incorporated by reference herein in their entireties.

BACKGROUND OF THE INVENTION

1. Field of the Invention

The present invention relates to an image-forming substrate coated with a layer of microcapsules filled with dye or ink, on which an image is formed by selectively breaking or squashing the micorcapsules in the layer of microcapsules. This invention also relates to an image-forming system using such an image-forming substrate.

2. Description of the Related Art

In a conventional type of image-forming substrate with a layer of microcapsules filled with dye or ink, a shell of each microcapsule is formed from a suitable photo-setting resin, and an optical image is recorded and formed as a latent image on the layer of microcapsules by exposing it to light rays in accordance with image-pixel signals. Then, the latent image is developed by exerting pressure on the layer of microcapsules. Namely, the microcapsules, which are not exposed to the light rays, are squashed and broken, whereby the dye or ink seeps out of the squashed and broken micorcapsules, and thus the latent image is visually developed by the seepage of the dye or ink.

Of course, each of the conventional image-forming substrates must be packed so as to be protected from being exposed to light, resulting in wastage of materials. Further, the image-forming substrates must be handled such that they are not subjected to excess pressure due to the softness of unexposed microcapsules, resulting in an undesired seepage of the dye or ink.

SUMMARY OF THE INVENTION

Therefore, an object of the present invention is to provide an easy-to-handle image-forming substrate coated with a layer of microcapsules filled with dye or ink, for which it is unnecessary to protect against exposure to light.

Another object of the present invention is to provide an image-forming system using the above-mentioned image-forming substrate.

In accordance with a first aspect of the present invention, there is provided an image-forming substrate comprising a base member, and a layer of microcapsules, coated over the base member, that contains at least one type of microcapsule filled with a dye. The at least one type of microcapsule exhibits a pressure/temperature characteristic such that, when the at least one type of microcapsule is squashed and broken under a predetermined pressure at a predetermined temperature, the dye seeps from the squashed and broken microcapsules. The at least one type of microcapsule is coated with a radiation absorbent material absorbing electromagnetic radiation, having a specific wavelength, so as to be heated to the predetermined temperature by irradiation with a beam of radiation having the specific wavelength. Preferably, the radiation absorbent material comprises an infrared absorbent pigment exhibiting one of a transparent pigmentation and a milky white pigmentation.

According to the first aspect of the present invention, the layer of microcapsules may contain at least two types of microcapsules: a first type-of microcapsule filled with a first dye, and a second type of microcapsule filled with a second dye. In this case, each of the first and second types of microcapsules exhibits a pressure/temperature characteristic such that, when each of the first and second types of microcapsules is squashed and broken under a predetermined pressure at a predetermined temperature, the dye concerned seeps from the squashed and broken microcapsule. Also, the first type of microcapsule is coated with a first radiation absorbent material absorbing electromagnetic radiation having a first specific wavelength, so as to be heated to the first predetermined temperature by irradiation with a first beam of radiation having the first specific wavelength, and the second type of microcapsule is coated with a second radiation absorbent material absorbing electromagnetic radiation having a second specific wavelength, so as to be heated to the second predetermined temperature by irradiation with a second beam of radiation having the second specific wavelength. Preferably, the first radiation absorbent material comprises a first infrared absorbent pigment that exhibits one of a transparent pigmentation and a milky white pigmentation, and the second radiation absorbent material comprises a second infrared absorbent pigment that exhibits one of a transparent pigmentation and a milky white pigmentation.

Also, in accordance with the first aspect of the present invention, there is provided an image-forming system using the above-mentioned image-forming substrate, the layer of microcapsules of which contains the at least one type of microcapsule. In this case, an image-forming apparatus is used to form an image on the image-forming substrate, and includes a pressure application unit that exerts the predetermined pressure on the layer of microcapsules, and an irradiating unit that irradiates the layer of microcapsules with a beam of radiation having the specific wavelength, such that a portion of the layer of microcapsules, irradiated by the beam of radiation, are heated to the predetermined temperature.

In the image-forming system, the irradiating unit may comprise an optical scanning system that includes a radiation beam emitter that emits the beam of radiation, and an optical deflector that deflects the beam of radiation so as to scan the layer of microcapsules with the deflected beam of radiation. Preferably, the radiation beam emitter comprises an infrared source that emits an infrared beam as the beam of radiation.

In the image-forming system according to the first aspect of the present invention, the above-mentioned image-forming substrate, that includes the layer of microcapsules containing the first and second types of microcapsules, may be used. In this case, to form an image on the image-forming substrate, an image-forming apparatus is used, which includes a pressure application unit that exerts the predetermined pressure on the layer of microcapsules, and an irradiating unit that irradiates the layer of microcapsules with a first beam of radiation having the first specific wavelength, and a second beam of radiation having the second specific wavelength, such that a portion of the first and second types of microcapsules, irradiated by the first and second beams of radiation, are heated to the predetermined temperature.

The irradiating unit may comprise an optical scanning system that includes a first radiation beam emitter that emits the beam of radiation, a second radiation beam emitter that emits the second beam of radiation, and an optical deflector that deflects the respective first and second beams of radiation so as to scan the layer of microcapsules with the deflected first and second beams of radiation. Preferably, the first radiation beam emitter comprises a first infrared source that emits a first infrared beam as the first beam of radiation, and the second radiation beam emitter comprises a second infrared source that emits a second infrared beam as the second beam of radiation.

In accordance with a second aspect of the present invention, there is provided an image-forming substrate comprising a base member, and a layer of microcapsules, coated over the base member, that contains at least a first type of microcapsule filled with a first dye. The first type of microcapsule exhibits a first pressure/temperature characteristic such that, when the first type of microcapsule is squashed and broken under a first predetermined pressure at a first predetermined temperature, the first dye seeps from the squashed and broken microcapsule. The layer of microcapsules may further contains a second type of microcapsule filled with a second dye. The second type of microcapsule exhibits a second pressure/temperature characteristic such that, when the second type of microcapsule is squashed and broken under a second predetermined pressure at a second predetermined temperature, the second dye seeps from the squashed and broken microcapsule. In either case, the image-forming substrate further comprises a sheet of transparent film, covering the layer of microcapsules, that contains a radiation absorbent material absorbing electromagnetic radiation having a specific wavelength, and the sheet of transparent film is selectively heated to the respective first and second predetermined temperatures by irradiation with a first beam of radiation having the specific wavelength and a second beam of radiation having the specific wavelength. Preferably, the radiation absorbent material comprises an infrared absorbent pigment that exhibits one of a transparent pigmentation and a milky white pigmentation.

Also, in accordance with the second aspect of the present invention, there is provided an image-forming system using the above-mentioned image-forming substrate, the layer of microcapsules of which contains only the first type of microcapsule. In this case, an image-forming apparatus is used to form an image on the image-forming substrate, and include a first pressure application unit that exerts the first predetermined pressure on the layer of microcapsules, and an irradiating unit that irradiates the layer of microcapsules with a first beam of radiation having the specific wavelength, such that a plurality of the first type of microcapsules, encompassed by a local area of the sheet of transparent film irradiated by the first beam of radiation,. is heated to the first predetermined temperature. The irradiating unit may comprise an optical scanning system that includes a first radiation beam emitter that emits the first beam of radiation, and an optical deflector that deflects the first beam of radiation so as to scan the sheet of transparent film with the deflected beam of radiation. Preferably, the first radiation beam emitter comprises a first infrared source that emits an infrared beam as the first beam of radiation.

In the image-forming system according to the second aspect of the present invention, when the layer of microcapsules of the image-forming substrate contains the first and second types of microcapsules, the image-forming apparatus further includes a second pressure application unit that exerts the second predetermined pressure on the layer of microcapsules, and the irradiating unit further irradiates the layer of microcapsules with a second beam of radiation having the specific wavelength, such that a plurality of the second type of microcapsules, encompassed by a local area of the sheet of transparent film irradiated by the second beam of radiation, is heated to the second predetermined temperature. In this case, the irradiating unit further comprises a second radiation beam emitter that emits the second beam of radiation, and the second beam of radiation is deflected by the optical deflector such that the sheet of transparent film is scanned with the deflected second beam of radiation. Preferably, the second radiation beam emitter also comprises a second infrared source that emits an infrared beam as the second beam of radiation.

In accordance with a third aspect of the present invention, there is provided an image-forming system which comprises an image-forming substrate including a base member, and a layer of microcapsules, coated over the base member, that contains at least one type of microcapsule filled with a dye. The at least one type of microcapsule exhibits a pressure/temperature characteristic such that, when the at least one type of microcapsule is squashed and broken under a predetermined pressure at a predetermined temperature, the dye seeps from the squashed and broken microcapsule. The image-forming system further comprises an image-forming apparatus that forms an image on the image-forming substrate, the image-forming apparatus including a pressure application unit that exerts the predetermined pressure on the layer of microcapsules, the pressure application unit including a transparent plate member, a layer of radiation absorbent material coated over a surface of the transparent plate member, and a platen member elastically pressed against the layer of radiation absorbent material at the predetermined pressure, with the image-forming substrate being interposed between the platen member and the layer of radiation absorbent material, the image-forming apparatus further including an irradiating unit that irradiates the layer of radiation absorbent material with a beam of radiation, such that a portion of the layer of microcapsules, encompassed by a local area of the layer of radiation absorbent material irradiated by the beam of radiation, is heated to the predetermined temperature.

In accordance with the third aspect of the present invention, there is further provided an image-forming system which comprises an image-forming substrate including a base member, a layer of microcapsules, coated over the base member, that contains a first type of microcapsule filled with a first dye, and a second type of microcapsule filled with a second dye. The first type of microcapsule exhibits a first pressure/temperature characteristic such that, when the first type of microcapsule is squashed and broken under a first predetermined pressure at a first predetermined temperature, the first dye seeps from the squashed and broken microcapsule. The second type of microcapsule exhibits a second pressure/temperature characteristic such that, when the second type of microcapsule is squashed and broken under a second predetermined pressure at a second predetermined temperature, the second dye seeps from the squashed and broken microcapsule. The image-forming system further comprises an image-forming apparatus that forms an image on the image-forming substrate, the image-forming apparatus including a pressure application unit that exerts the first and second predetermined pressures on the layer of microcapsules, the pressure application unit including a transparent plate member, a layer of radiation absorbent material coated over a surface of the transparent plate member, a first platen member elastically pressed against the layer of radiation absorbent material at the first predetermined pressure, and a second platen member elastically pressed against the layer of radiation absorbent material at the second predetermined pressure, with the image-forming substrate being interposed between the first and second platen members and the layer of radiation absorbent material, the image-forming apparatus further including an irradiating unit that irradiates the layer of radiation absorbent material with a first beam of radiation and a second beam of radiation, such that two portions of the layer of microcapsules, encompassed by two local areas of the layer of radiation absorbent material irradiated by the first and second beams of radiation, are heated to the first and second predetermined temperatures.

BRIEF DESCRIPTION OF TEE DRAWINGS

These objects and other objects of the present invention will be better understood from the following description, with reference to the accompanying drawings in which.

DESCRIPTION OF THE PREFERRED EMBODIMENTS

Figure 1:
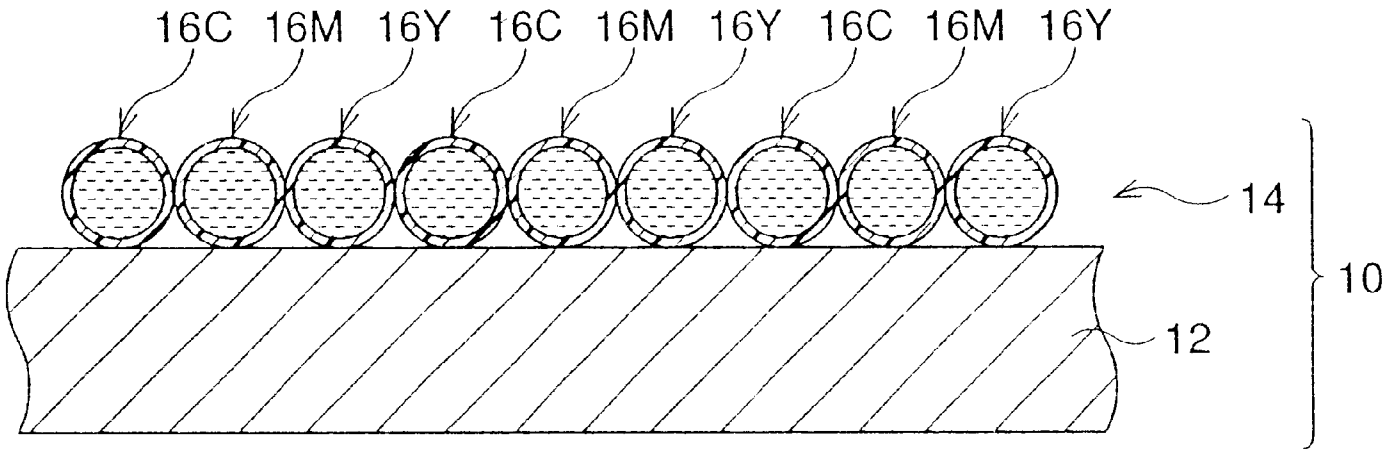
FIG. 1 is a schematic conceptual cross-sectional view showing an image-forming substrate using three types of microcapsules: cyan microcapsules filled with a cyan dye; magenta microcapsules filled with a magenta dye; and yellow microcapsules filled with a yellow dye, used in a first embodiment of an image-forming system according to the present invention.

FIG. 1 shows an image-forming substrate, generally indicated by reference 10, which may be used in a first embodiment of an image-forming system according to the present invention. The image-forming substrate 10 is produced in a form of a paper sheet. Namely, the image-forming substrate or sheet 10 comprises a sheet of paper 12, and a layer of microcapsules 14 coated over a surface of the sheet of paper 12.

The microcapsule layer 14 is formed of three types of microcapsules: a first type of microcapsules 16C filled with cyan liquid dye or ink, a second type of microcapsules 16M filled with magenta liquid dye or ink, and a third type of microcapsules 16Y filled with yellow liquid dye or ink. In each type of microcapsule (16C, 16M, 16Y), a shell wall of a microcapsule is formed of a suitable synthetic resin material, usually colored white, which is the same color as the sheet of paper 12. Accordingly, if the sheet of paper 12 is colored with a single color pigment, the resin material of the microcapsules 16C, 16M and 16Y may be colored by the same single color pigment.

Further, according to the first embodiment of the present invention, the cyan microcapsules 16C are coated with a first type of infrared absorbent pigment absorbing infrared rays having a wavelength of $\lambda_C$, the magenta microcapsules 16M are coated with a second type of infrared absorbent pigment absorbing infrared rays having a wavelength of $\lambda_M$, and the yellow microcapsules 16Y are coated with a third type of infrared absorbent pigment absorbing infrared rays having a wavelength of $\lambda_Y$. For example, the wavelengths $\lambda_C$, $\lambda_M$ and $\lambda_Y$ are 778 $\mu$m, 814 $\mu$m and 831 $\mu$m, respectively, and the respective infrared absorbent pigments, able to absorb electromagnetic radiation having wavelengths of 778 $\mu$m, 814 $\mu$m and 831 $\mu$m, are available as products NK-2014, NK-1144 and NK-2268 from NIPPON OPTICAL SENSITIVE PIGMENTS LABORATORY. Note, under normal conditions, these infrared absorbent pigments are transparent or milky white to human vision.

In order to produce each of the types of microcapsules 16C, 16M and 16Y, a well-known polymerization method, such as interfacial polymerization, in-situ polymerization or the like, may be utilized, and the produced microcapsules are coated with a given infrared absorbent pigment in a suitable manner. In either case, the microcapsules 16C, 16M and 16Y may have an average diameter of several microns, for example, 5 $\mu$m to 10 $\mu$m.

The first, second and third types of microcapsules 16C, 16M and 16Y are uniformly distributed in the microcapsule layer 14. For the uniform formation of the microcapsule layer 14, for example, the same amounts of cyan, magenta and yellow microcapsules 16C, 16M and 16Y are homogeneously mixed with a suitable binder solution to form a suspension, and the paper sheet 12 is coated with the binder solution, containing the suspension of microcapsules 16C, 16M and 16Y, by using an atomizer. In FIG. 1, for the convenience of illustration, although the microcapsule layer 14 is shown as having a thickness corresponding to the diameter of the microcapsules 16C, 16M and 16Y, in reality, the three types of microcapsules 16C, 16M and 16Y overlay each other, and thus the microcapsule layer 14 has a larger thickness than the diameter of a single microcapsule 16C, 16M or 16Y.

In the image-forming sheet 10 shown in FIG. 1, for the resin material of the first, second and third types of microcapsules 16C, 16M and 16Y, a shape memory resin may be utilized. For example, the shape memory resin is represented by a polyurethane-based-resin, such as polynorbornene, trans-1, 4-polyisoprene polyurethane. As other types of shape memory resin, a polyimide-based resin, a polyamide-based resin, a polyvinyl-chloride-based resin, a polyester-based resin and so on are also known.

Figure 2:
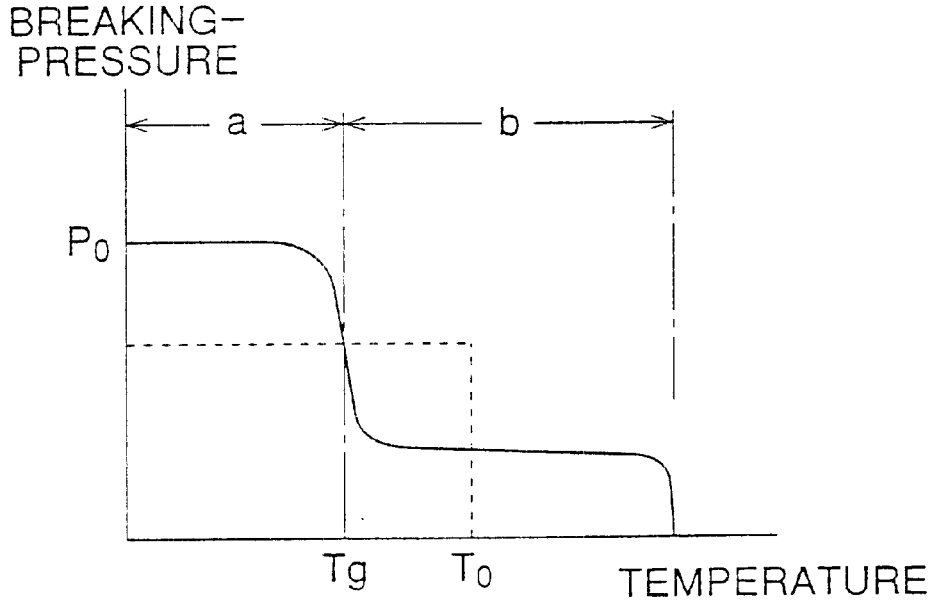
FIG. 2 is a graph showing a pressure/temperature breaking characteristic of the cyan, magenta and yellow microcapsules shown in FIG. 1.

In general, as shown in a graph of FIG. 2, the shape memory resin exhibits a coefficient of longitudinal elasticity, which abruptly changes at a glass-transition temperature boundary $T_g$. In the shape memory resin, Brownian movement of the molecular chains is stopped in a low-temperature area "a", which is below the glass-transition temperature $T_g$, and thus the shape memory resin exhibits a glass-like phase. On the other hand, Brownian movement of the molecular chains becomes increasingly energetic in a high-temperature area "b", which is above the glass-transition temperature $T_g$, and thus the shape memory resin exhibits a rubber elasticity.

The shape memory resin is named due to the following shape memory characteristic: once a mass of the shape memory resin is worked into a finished article in the low-temperature area "a", and is heated to beyond the glass-transition temperature $T_g$, the article becomes freely deformable. After the shaped article is deformed into another shape, and cooled to below the glass-transition temperature $T_g$, the most recent shape of the article is fixed and maintained. Nevertheless, when the deformed article is again heated to above the glass-transition temperature $T_g$, without being subjected to any load or external force, the deformed article returns to the original shape.

In the image-forming substrate or sheet 10, the shape memory characteristic per se is not utilized, but the characteristic abrupt change of the shape memory resin in the longitudinal elasticity coefficient is utilized, such that. the three types of microcapsules 16C, 16M and 16Y can be selectively squashed and broken at a predetermined temperature and under a predetermined pressure in conjunction with the first, second and third infrared absorbent pigments, with which the three types of microcapsules 16C, 16M and 16Y are coated, respectively.

In particular, if a thickness of a shell wall of the cyan microcapsules 16C, magenta microcapsules 16M and yellow microcapsules 16Y is selected such that the shell wall is broken by a pressure $P_0$ when being heated to a temperature $T_0$ (FIG. 2), the three types of microcapsules 16C, 16M and 16Y, included in the microcapsule layer 14 of the image-forming sheet 10, can be selectively squashed and broken by selectively irradiating and scanning the microcapsule layer 14 with three types of infrared beams, having wavelengths 778 $\mu$m, 814 $\mu$m and 831 $\mu$m, respectively, until the irradiated area is heated to the temperature $T_0$, while exerting the pressure $P_0$ on the microcapsule layer 14 of the image-forming sheet 10.

Figure 3:
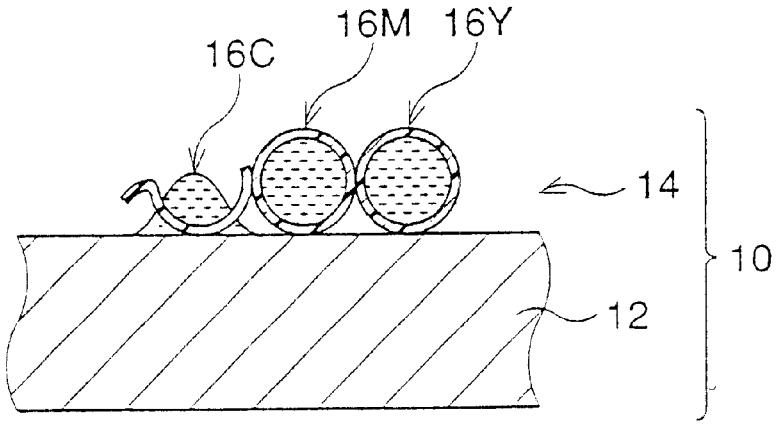
FIG. 3 is a schematic conceptual cross-sectional view similar to FIG. 1, showing only a selective breakage of a cyan microcapsule in the layer of microcapsules.

For example, when the image-forming sheet 10 is subjected to the pressure $T_0$, and when a local area of the microcapsule layer 14 is irradiated with the infrared beam, having the wavelength of 778 $\mu$m, until the irradiated local area 14 is heated to the temperature $T_0$, only the cyan microcapsules 16C, included in the irradiated local area, are squashed and broken, as representatively shown in FIG. 3.

Accordingly, if the respective irradiations of the microcapsule layer 14 with the three types of infrared beams, having wavelengths 778 $\mu$m, 814 $\mu$m and 831 $\mu$m, are suitably controlled in accordance with a series of digital color image-pixel signals, i.e. digital cyan image-pixel signals, digital magenta image-pixel signals and digital yellow image-pixel signals, it is possible to form a color image on the image-forming sheet 10 on the basis of the series of digital color image-pixel signals.

Figure 4:
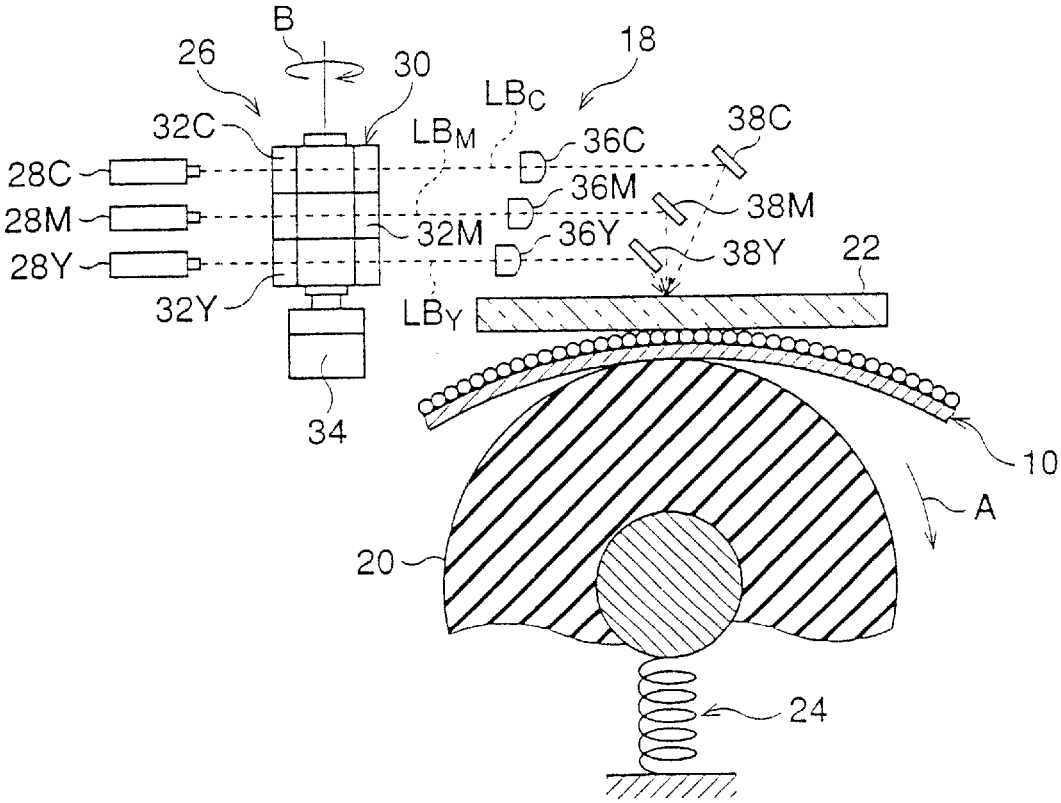
FIG. 4 is a schematic conceptual view showing a color printer used in the first embodiment of the image-forming system according to the present invention.

FIG. 4 schematically shows a color printer, generally indicated by reference 18, which may be used in the first embodiment of the image-forming system according to the present invention, and which is constituted as a line printer so as to form a color image on the image-forming sheet 10.

The color printer 18 comprises a roller platen 20 rotatably supported by a structural frame (not shown) of the printer 18, and an elongated transparent glass plate 22 immovably supported by the structural frame of the printer 18 and associated with the roller platen 20, with the glass plate 22 coextending with the roller platen 20. The roller platen 20 is provided with a spring-biasing unit 24, as symbolically and conceptually shown in FIG. 4, and the spring-biasing unit 24 acts on the ends of a shaft of the roller platen 20 in such a manner that the roller platen 20 is elastically pressed against the glass plate 22 at the pressure $P_0$.

During a printing operation, the roller platen 20 is intermittently rotated in a clockwise direction, indicated by an arrow A in FIG. 4, by a suitable electric motor (not shown), such as a stepping motor, a servo motor, or the like, and the image-forming sheet 10 is introduced into and passed through a nip between the platen roller 20 and the glass plate 22, in such a manner that the microcapsule layer 14 of the image-forming sheet 10 comes into contact with the glass plate 22. Thus, the image-forming sheet 10 is subjected to the pressure $P_0$ when intermittently moving between the roller platen 20 and the glass plate 22.

Figure 5:
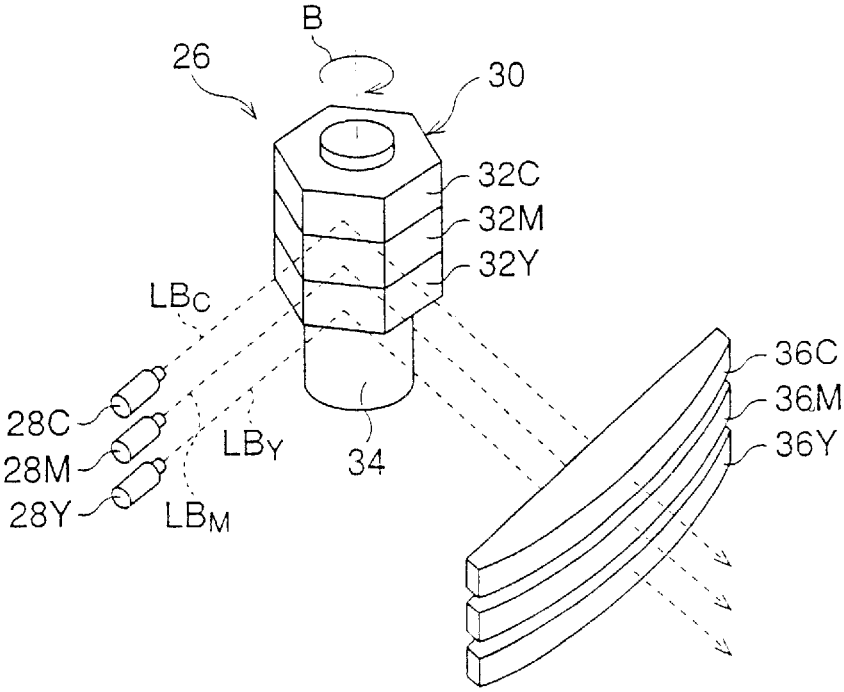
FIG. 5 is a schematic perspective view showing an optical scanning system incorporated in the color printer of FIG. 4.

The printer 18 further comprises an optical scanning system, generally indicated by reference 26, a part of which is illustrated as a perspective view in FIG. 5. The optical scanning system 26 is used to successively form a color image line by line on the microcapsule layer 14 of the image-forming sheet 10 in accordance with a series of digital color image-pixel signals, i.e. a single-line of digital cyan image-pixel signals, a single-line of digital magenta image-pixel signals and a single-line of digital-yellow image-pixel signals.

In particular, the optical scanning system 26 includes three types of infrared laser sources 28C, 28M and 28Y, each of which may comprise a laser diode. The infrared laser source 28C is constituted so as to emit an infrared laser beam $LB_C$ having a wavelength of 778 $\mu$m, the infrared laser source 28M is constituted so as to emit an infrared laser beam $LB_M$ having a wavelength of 814 $\mu$m, and the infrared laser source 28Y is constituted so as to emit infrared laser beam $LB_Y$ having a wavelength of 831 $\mu$m.

The optical scanning system 26 also includes a polygon mirror assembly 30, having polygon mirror elements 32C, 32M and 32Y, and the polygon mirror assembly 30 is rotated by a suitable electric motor 34 in a rotational direction indicated by an arrow B in FIGS. 4 and 5. The optical scanning system 26 further includes fθ lenses 36C, 36M and 36Y associated with the respective polygon mirror elements 32C, 32M and 32Y, and reflective elongated mirror elements 38C, 38M and 38Y associated with the respective fθ lenses 36C, 36M and 36Y and coextending therewith.

As best shown in FIG. 5, the infrared laser beam $LB_C$, emitted from the infrared laser source 28C, is made incident on one of the reflective faces of the rotating polygon mirror element 32C, and is deflected onto the fθ lens 36C. The deflected infrared laser beam $LB_C$ passes through the fθ lens 36C, to become incident on the reflective mirror element 38C, whereby the deflected infrared laser beam $LB_C$ is reflected toward a resilient contact line between the roller platen 20 and the glass plate 22.

In short, as shown in FIG. 4, when the image-forming sheet 10 is interposed between the roller platen 20 and the glass plate 22, a linear area of the microcapsule layer 14, corresponding to the contact line between the roller platen 20 and the glass plate 22, is scanned with the infrared laser beam $LB_C$, derived from the infrared laser source 28C and deflected by the polygon mirror element 32C.

While the linear area of the microcapsule layer 14 is scanned with the deflected infrared laser beam $LB_C$, the emission of the infrared laser beam $LB_C$ from the infrared laser source 28C is controlled so as to be switched ON and OFF in accordance with a single-line of digital cyan image-pixel signals, in substantially the same manner as in a conventional laser printer. Namely, when one of the digital cyan image-pixel signals included in the single-line has a value [1], the emission of the infrared laser beam $LB_C$ from the infrared laser source 28C is switched ON, but when one of the digital cyan image-pixel signals included in the single-line has a value [0], the emission of the infrared laser beam $LB_C$ from the infrared laser source 28C is switched OFF.

During the switching ON of the emission of the infrared laser beam $LB_C$ from the infrared laser source 28C, a local spot on the linear area of the microcapsule layer 14 is irradiated by the infrared laser beam $LB_C$ (778 $\mu$m), so that only the cyan microcapsules 16C included in the local spot are heated to the temperature $T_0$ due to the first type of infrared absorbent pigment coatings thereof, thereby causing only the cyan microcapsules 16C included in the local spot to squash and break, resulting in a seepage of cyan dye from the squashed and broken cyan microcapsules 16C. Thus, the local spot is developed as a cyan dot on the linear area of the microcapsule layer 14.

The same is true for the respective infrared laser beams $LB_M$ and $LB_Y$ emitted from the infrared laser sources 28M and 28Y. Namely, the linear area of the microcapsule layer 14, corresponding to the contact line between the roller platen 20 and the glass plate 22, is scanned with the respective infrared laser beams $LB_M$ and $LB_Y$ deflected by the polygon mirror elements 32M and 32Y and reflected by the mirror elements 38M and 38Y through the fθ lenses 36M and 36Y. The respective emissions of the infrared laser beams $LB_M$ and $LB_Y$ from the infrared laser sources 28M and 28Y are controlled so as to be switched ON and OFF in accordance with a single-line of digital magenta image-pixel signals and a single-line of digital yellow image-pixel signals in the same manner as mentioned above.

Of course, during the switching ON of the emission of the infrared laser beam $LB_M$ from the infrared laser source 28M in response to a value [1] of a digital magenta image-pixel signal, a local spot on the linear area of the microcapsule layer 14 is irradiated by the infrared laser beam $LB_M$ (814 $\mu$m), so that only the magenta microcapsules 16M included in the local spot are heated to the temperature $T_0$ due to the second type of infrared absorbent pigment coatings thereof, thereby causing only the magenta microcapsules 16M included in the local spot to squash and break, resulting in a seepage of magenta dye from the squashed and broken magenta microcapsules 16M. Thus, the local spot is developed as a magenta dot on the linear area of the microcapsule layer 14.

Similarly, during the switching ON of the emission of the infrared laser beam $LB_Y$ from the infrared laser source 28Y in response to a value [1] of a digital yellow image-pixel signal, a local spot on the linear area of the microcapsule layer 14 is irradiated by the infrared laser beam $LB_Y$ (831 $\mu$m), so that only the yellow microcapsules 16Y included in the local spot are heated to the temperature $T_0$ due to the third type of infrared absorbent pigment coatings thereof, thereby causing only the yellow microcapsules 16Y included in the local spot to squash and break, resulting in a seepage of yellow dye from the squashed and broken yellow microcapsules 16Y. Thus, the local spot is developed as a yellow dot on the linear area of the microcapsule layer 14.

Thus, according to the above-mentioned color printer 18, it is possible to form a color image on the microcapsule layer 14 of the image-forming sheet 10 on the basis of the series of digital color image-pixel signals, i.e. digital cyan image-pixel signals, digital magenta image-pixel signals and digital yellow image-pixel signals.

Note, a lower surface of the glass plate 22, which is in contact with the microcapsule layer 14 of the image-forming sheet 10, is preferably treated to exhibit a repellency, so that the seeped dyes are prevented from being transferred to the lower surface of the glass plate 22, whereby the image-forming sheet 10 is kept from being stained or smudged with the transferred dyes. Optionally, the image-forming sheet 10 may be provided with a sheet of protective transparent film covering the microcapsule layer 14.

Figure 6:
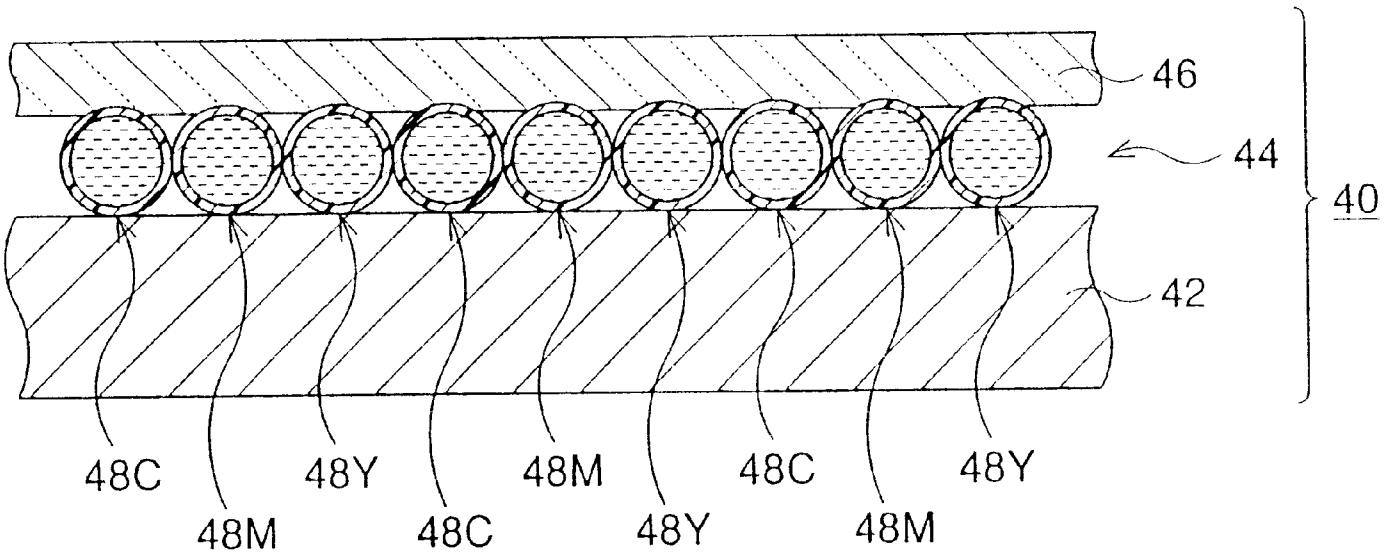
FIG. 6 is a schematic conceptual cross-sectional view showing an image-forming substrate using three types of microcapsules: cyan microcapsules filled with a cyan dye; magenta microcapsules filled with a magenta dye; and yellow microcapsules filled with a yellow dye, used in a second embodiment of the image-forming system according to the present invention.

FIG. 6 shows an image-forming substrate, generally indicated by reference 40, which may be used in a second embodiment of the image-forming system according to the present invention. The image-forming substrate 40 is produced in a form of a paper sheet, and comprises a sheet of paper 42, and a layer of microcapsules 44 coated over a surface of the paper sheet 42, and a sheet of protective transparent film 46 covering the microcapsule layer 44.

Similar to the microcapsule layer 14 of the first-mentioned image-forming sheet 10, the microcapsule layer 44 is formed from three types of microcapsules: a first type of microcapsules 48C filled with cyan liquid dye or ink, a second type of microcapsules 48M filled with magenta liquid dye or ink, and a third type of microcapsules 48Y filled with yellow liquid dye or ink, and these microcapsules 48C, 48M and 48Y are uniformly distributed in the layer of microcapsules 44. Also, in each type of microcapsule (48C, 48M, 48Y), a shell wall of a microcapsule is formed of a suitable shape memory resin material, usually colored white, which is the same color as the paper sheet 42. Thus, if the paper sheet 44 is colored with a single color pigment, the resin material of the microcapsules 48C, 48M and 48Y may be colored by the same single color pigment.

In the image-forming substrate or sheet 40, the three types of microcapsules 48C, 48M and 48Y are not coated with any infrared absorbent pigment able to absorb infrared rays, but the protective transparent film sheet 46 contains infrared absorbent pigment which can absorb infrared rays. For example, for the infrared absorbent pigment contained in the protective transparent film sheet 46, it is possible to utilize the above-mentioned product NK-2014, which absorbs infrared rays having a wavelength of 778 $\mu$m.

Similar to the above-mentioned microcapsules (16C, 16M and 16Y) of the image-forming substrate 10, by the well-known polymerization method, it is possible to produce each of the types of microcapsules 48C, 48M and 48Y, having an average diameter of several microns, for example, 5 $\mu$m. Also, the uniform formation of the microcapsule layer 44 may be carried out in substantially the same manner as the microcapsule layer 14 of the image-forming sheet 10. Of course, in FIG. 6, for the convenience of illustration, although the microcapsule layer 44 is shown as having a thickness corresponding to the diameter of the microcapsules 48C, 48M and 48Y, in reality, the three types of microcapsules 48C, 48M and 48Y overlay each other, and thus the microcapsule layer 44 has a larger thickness than the diameter of a single microcapsule 48C, 48M or 48Y.

Figure 7:
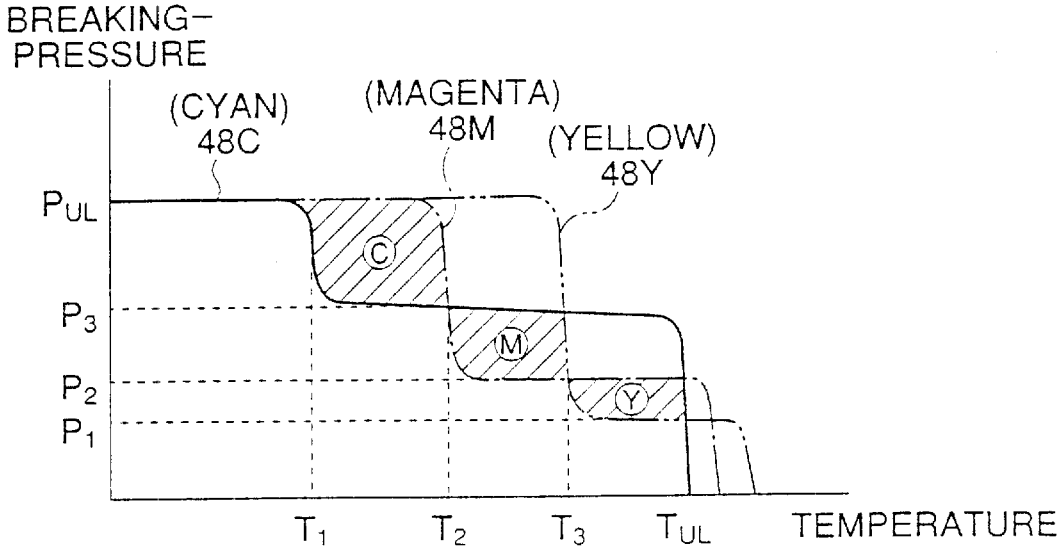
FIG. 7 is a graph showing pressure/temperature breaking characteristics of the respective cyan, magenta and yellow microcapsules shown in FIG. 6, with each of a cyan-developing area, a magenta-developing area and a yellow-developing area being indicated as a hatched area.

As shown in a graph of FIG. 7, a shape memory resin of the cyan microcapsules 48C is prepared so as to exhibit a characteristic longitudinal elasticity coefficient having a glass-transition temperature $T_1$, indicated by a solid line; a shape memory resin of the magenta microcapsules 48M is prepared so as to exhibit a characteristic longitudinal elasticity coefficient having a glass-transition temperature. $T_2$, indicated by a single-chained line; and a shape memory resin of the yellow microcapsules 48Y is prepared so as to exhibit a characteristic longitudinal elasticity coefficient, indicated by a double-chained line, having a glass-transition temperature $T_3$.

Note, by suitably varying compositions of the shape memory resin and/or by selecting a suitable one from among various types of shape memory resin, it is possible to obtain the respective shape memory resins, with the glass-transition temperatures $T_1$, $T_2$ and $T_3$.

Figure 8:
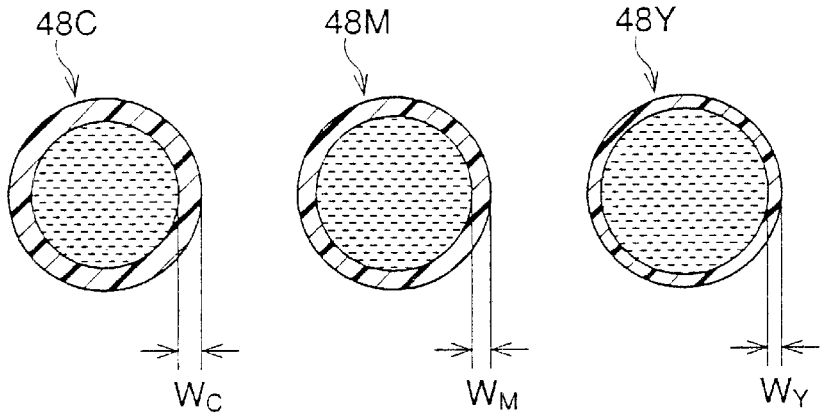
FIG. 8 is a schematic cross-sectional view showing different shell wall thicknesses of the respective cyan, magenta and yellow microcapsules shown in FIG. 6.

Also, as shown in FIG. 8, the microcapsule walls $W_C$, $W_M$ and $W_Y$ of the cyan microcapsules 48C, magenta microcapsules 48M, and yellow microcapsules 48Y, respectively, have differing thicknesses. The thickness $W_C$ of the cyan microcapsules 48C is larger than the thickness $W_M$ of the magenta microcapsules 48M, and the thickness $W_M$ of the magenta microcapsules 48M is larger than the thickness $W_Y$ of the yellow microcapsules 48Y.

The wall thickness $W_C$ of the cyan microcapsules 48C is selected such that each cyan microcapsule 48C is compacted and broken under a breaking pressure that lies between a critical breaking pressure $P_3$ and an upper limit pressure $P_{UL}$ (FIG. 7), when each cyan microcapsule 48C is heated to a temperature between the glass-transition temperatures $T_1$ and $T_2$; the wall thickness $W_M$ of the magenta microcapsules 48M is selected such that each magenta microcapsule 48M is compacted and broken under a breaking pressure that lies between a critical breaking pressure $P_2$ and the critical breaking pressure $P_3$ (FIG. 7), when each magenta microcapsule 48M is heated to a temperature between the glass-transition temperatures $T_2$ and $T_3$; and the wall thickness $W_Y$ of the yellow microcapsules 48Y is selected such that each yellow microcapsule 48Y is compacted and broken under a breaking pressure that lies between a critical breaking pressure $P_1$ and the critical breaking pressure $P_2$ (FIG. 7), when each yellow microcapsule 4BY is heated to a temperature between the glass-transition temperature $T_3$ and an upper limit temperature $T_{UL}$.

Note, the upper limit pressure $P_{UL}$ and the upper limit temperature $T_{UL}$ are suitably set in view of the characteristics of the used shape memory resins.

Thus, by suitably selecting a heating temperature and a breaking pressure, which should be exerted on the image-forming sheet 40, it is possible to selectively compact and break the cyan, magenta and yellow microcapsules 48C, 48M and 48Y.

Figure 9:
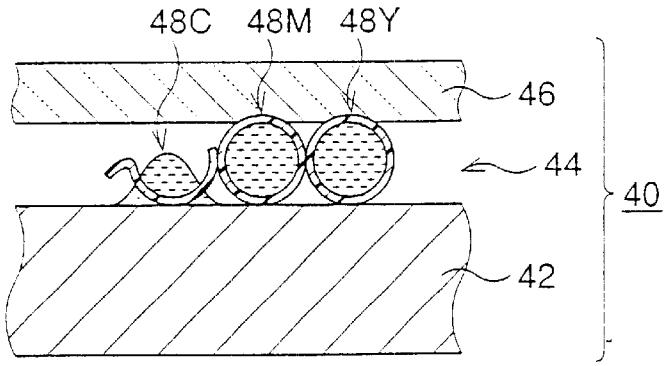
FIG. 9 is a schematic conceptual cross-sectional view similar to FIG. 6, showing only a selective breakage of a cyan microcapsule in the layer of microcapsules.

For example, if the selected heating temperature and breaking pressure fall within a hatched cyan area C (FIG. 7), defined by a temperature range between the glass-transition temperatures $T_1$ and $T_2$ and by a pressure range between the critical breaking pressure $P_3$ and the upper limit pressure $P_{UL}$, only the cyan microcapsules 48C are compacted and broken, as shown in FIG. 9. Also, if the selected heating temperature and breaking pressure fall within a hatched magenta area M, defined by a temperature range between the glass-transition temperatures $T_2$ and $T_3$ and by a pressure range between the critical breaking pressures $P_2$ and $P_3$, only the magenta microcapsules 48M are compacted and broken. Further, if the selected heating temperature and breaking pressure fall within a hatched yellow area Y, defined by a temperature range between the glass-transition temperature $T_3$ and the upper limit temperature $T_{UL}$ and by a pressure range between the critical breaking pressures $P_1$ and $P_2$, only the yellow microcapsules 48Y are broken and squashed.

Accordingly, if the selection of a heating temperature and a breaking pressure, which should be exerted on the image-forming sheet 40, are suitably controlled in accordance with a series of digital color image-pixel signals: digital cyan image-pixel signals, digital magenta image-pixel signals and digital yellow image-pixel signals, it is possible to form a color image on the image-forming sheet 40 on the basis of the digital color image-pixel signals.

Figure 10:
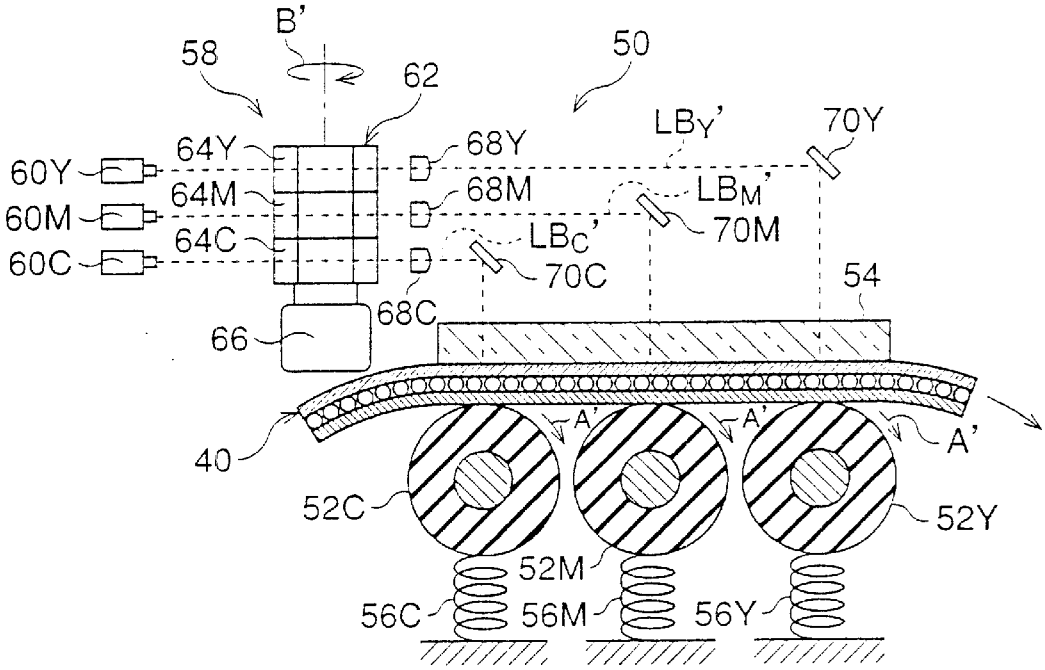
FIG. 10 is a schematic conceptual view showing a color printer used in the second embodiment of the image-forming system according to the present invention.

FIG. 10 schematically shows a color printer, generally indicated by reference 50, which may be used in the first embodiment of the image-forming system according to the present invention, and which is constituted as a line printer so as to form a color-image on the image-forming sheet 40.

The color printer 50 comprises a first roller platen 52C, a second platen 52M and a third platen 52Y, arranged to be parallel to each other and rotatably supported by a frame (not shown) of the printer 50, and an elongated transparent glass plate 54 immovably supported by the frame of the printer 50 and associated with the first, second and third roller platens 52C, 52M and 52Y. The roller platens 52C, 52M and 52Y are identical to each other and have a same length as each other, with the glass plate 54 coextending with each of the roller platens 52C, 52M and 52Y.

The respective roller platens 52C, 52M and 52Y are provided with a first spring-biasing unit 56C, a second spring-biasing unit 56M and a third spring-biasing unit 56Y, each of which is symbolically and conceptually shown in FIG. 10. The spring-biasing unit 56C acts on the ends of a shaft of the roller platen 52C such that the roller platen 52C is elastically pressed against the glass plate 54 at a pressure between the critical breaking-pressure $P_3$ and the upper limit pressure $P_{UL}$; the second spring-biasing unit 56M acts on the ends of the shaft of the roller platen 52M such that the roller platen 52M is elastically pressed against the glass plate 54 at a pressure between the critical breaking-pressures $P_2$ and $P_3$; and the third spring-biasing unit 56Y acts on the ends of the shaft of the roller platen 52Y such that the roller platen 52Y is elastically pressed against the glass plate 54 at a pressure between the critical breaking-pressures $P_1$ and $P_2$.

During a printing operation, each of the roller platens 52C, 52M and 52Y is intermittently rotated with a same peripheral speed in a clockwise direction, indicated by arrows A' in FIG. 10, by a suitable electric motor (not shown), such as a stepping motor, a servo motor, or the like. The image-forming sheet 40 is introduced into and passed through a nip between each platen roller (52C, 52M, 52Y) and the glass plate 54, in such a manner that the protective transparent film sheet 46 of the image-forming sheet 40 comes into contact with the glass plate 54.

Thus, the image-forming sheet 40 is subjected to pressure ranging between the critical breaking-pressure $P_3$ and the upper limit pressure $P_{UL}$ when passing through the nip between the first roller platen 52C and the glass plate 54; is subjected to pressure ranging between the critical breaking-pressures $P_2$ and $P_3$ when passing through the nip between the second roller platen 52M and the glass plate 54; and is subjected to pressure ranging between the critical breaking-pressures $P_1$ and $P_2$ when passing through the nip between the third roller platen 52Y and the glass plate 54.

Figure 11:
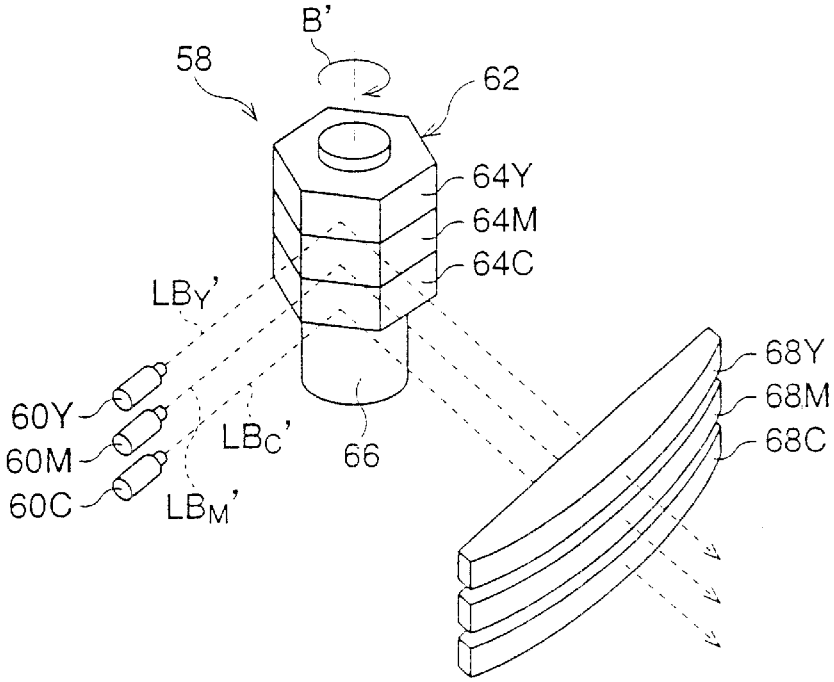
FIG. 11 is a schematic perspective view showing an optical scanning system incorporated in the color printer of FIG. 10.

The color printer 50 further comprises an optical scanning system, generally indicated by reference 58, a part of which is illustrated as a perspective view in FIG. 11. The optical scanning system 58 is used to successively form respective cyan, magenta and yellow images line by line on the microcapsule layer 44 of the image-forming sheet 40 in accordance with a single-line of digital cyan image-pixel signals, a single-line of digital magenta image-pixel signals and a single-line of digital yellow image-pixel signals.

In particular, the optical scanning system 58 includes three infrared laser sources 60C, 60M and 60Y, each of which may comprise a laser diode. For example, the respective infrared laser sources 60C, 60M and 60Y are constituted so as to emit infrared laser beams $LB_C'$, $LB_M'$ and $LB_Y'$, and these infrared laser beams $LB_C'$, $LB_M'$ and $LB_Y'$ have the same wavelength of 778 $\mu$m, but the powers of the infrared laser beams $LB_C'$, $LB_M'$ and $LB_Y'$ are different from each other. Namely, the power of the infrared laser beam $LB_C'$ is lower than that of the infrared laser beam $LB_M'$, and the power of the-infrared laser beam $LB_M'$ is lower than that of the infrared laser beam $LB_Y'$.

The optical scanning system 58 also includes a polygon mirror assembly 62, having polygon mirror elements 64C, 64M and 64Y, and the polygon mirror assembly 62 is rotated by a suitable electric motor 66 in a rotational direction indicated by an arrow B' in FIGS. 10 and 11. The optical scanning system 58 further includes fθ lenses 68C, 68M and 68Y associated with the respective polygon mirror elements 64c, 64M and 64Y, and reflective elongated mirror elements 70C, 70M and 70Y associated with,the respective fθ lenses 68C, 68M and 68Y and coextending therewith.

As best shown in FIG. 11, the infrared laser beam $LB_C'$, emitted from the infrared laser source 60C, is made incident on one of the reflective faces of the rotating polygon mirror element 64C, and is deflected onto the fθ lens 68C. The deflected infrared laser beam $LB_C'$ passes through the fθ lens 68C, before becoming incident on the reflective mirror element 70C, whereby the deflected infrared laser beam $LB_C'$ is reflected toward a contact line between the first roller platen 52C and the glass plate 54, along which the roller platen 52C is resiliently pressed against the glass plate 54.

In short, as shown in FIG. 10, when the image-forming sheet 40 is interposed between the first roller platen 52C and the glass plate 54, a first linear area of the image-forming sheet 40, and therefore, the protective transparent film sheet 46 thereof, corresponding to the contact line between the first roller platen 52C and the glass plate 54, is scanned with the infrared laser beam $LB_C'$, derived from the infrared laser source 60C and deflected by the polygon mirror element 64C.

Also, the infrared laser beam $LB_M'$, emitted from the infrared laser source 60M, is made incident on one of the reflective faces of the rotating polygon mirror element 64M, and is deflected onto the fθ lens 68M. The deflected infrared laser beam $LB_M'$ passes through the fθ lens 68M, before becoming incident on the reflective mirror element 70M, whereby the deflected infrared laser beam $LB_M'$ is reflected toward a contact line between the second roller platen 52M and the glass plate 54, along which the roller platen 52M is resiliently pressed against the glass plate 54. Thus, a second linear area of the protective transparent film sheet 46, corresponding to the contact line between the second roller platen 52M and the glass plate 54, is scanned with the infrared laser beam $LB_M'$, derived from the infrared laser source 60M and deflected by the polygon mirror element 64M.

Similarly, the infrared laser beam $LB_Y'$, emitted from the infrared laser source 60Y, is made incident on one of the reflective faces of the rotating polygon mirror element 64Y, and is deflected onto the fθ lens 68Y. The deflected infrared laser beam $LB_Y'$ passes through the fθ lens 68Y, before becoming incident on the reflective mirror element 70Y, whereby the deflected infrared laser beam $LB_Y'$ is reflected toward a contact line between the third roller platen 52Y and the glass plate 54, along which the third roller platen 52Y is resiliently pressed against the glass plate 54. Thus, a third linear area of the protective transparent film sheet 46, corresponding to the contact line between the third roller platen 52Y and the glass plate 54, is scanned with the infrared laser beam $LB_Y'$, derived from the infrared laser source 60Y and deflected by the polygon mirror element 64Y.

While the first linear area of the protective transparent film sheet 46 is scanned with the deflected infrared laser beam $LB_C'$, the emission of the infrared laser beam $LB_C'$ from the infrared laser source 60C is controlled so as to be switched ON and OFF in accordance with a single-line of digital cyan image-pixel signals, in substantially the same manner as in a conventional laser printer. Namely, when one of the digital cyan image-pixel signals included in the single-line has a value [1], the emission of the infrared laser beam $LB_C'$ from the infrared laser source 60C is switched ON, but when one of the digital cyan image-pixel signals, included in the single-line, has a value [0], the emission of the infrared laser beam $LB_C'$ from the infrared laser source 60C is switched OFF.

During the switching ON of the emission of the infrared laser beam $LB_C'$ from the infrared laser source 60C, a local spot on the first linear area of the protective transparent film sheet 46 is irradiated by the infrared laser beam $LB_C'$ (778 $\mu$m), and is thermally heated to-a temperature between the glass-transition temperatures $T_1$ and $T_2$. Namely, by taking a scanning speed of the infrared laser beam $LB_C'$ into account, the power of the infrared laser beam $LB_C'$ can be regulated so that a heating temperature of the local spot reaches the temperature between the glass-transition temperatures $T_1$ and $T_2$. Thus, only the cyan microcapsules 48C encompassed by the irradiated local spot are squashed and broken, resulting in a seepage of cyan dye from the squashed and broken cyan microcapsules 48C. Thus, the local spot is developed as a cyan dot on the first linear area of the microcapsule layer 44.

While the second linear area of the protective transparent film sheet 46 is scanned with the deflected infrared laser beam $LB_M'$, the emission of the infrared laser beam $LB_M'$ from the infrared laser source 60M is controlled so as to be switched ON and OFF in accordance with a single-line of digital magenta image-pixel signals, in substantially the same manner as in a conventional laser printer. Namely, when one of the digital magenta image-pixel signals included in the single-line has a value [1], the emission of the infrared laser beam $LB_M'$ from the infrared laser source 60M is switched ON, but when one of the digital magenta image-pixel signals, included in the single-line, has a value [0], the emission of the infrared laser beam $LB_M'$ from the infrared laser source 60M is switched OFF.

During the switching ON of the emission of the infrared laser beam $LB_M'$ from the infrared laser source 60M, a local spot on the second linear area of the protective transparent film sheet 46 is irradiated by the infrared laser beam $LB_M'$ (778 $\mu$m), and is thermally heated to a temperature between the glass-transition temperatures $T_2$ and $T_3$. Namely, by taking a scanning speed of the infrared laser beam $LB_M'$ into account, the power of the infrared laser beam $LB_M'$, which is higher than that of the infrared laser beam $LB_C'$, can be regulated so that a heating temperature of the local spot reaches the temperature between the glass-transition temperatures $T_2$ and $T_3$. Thus, only the magenta microcapsules 48M encompassed by the irradiated local spot are squashed and broken, resulting in a seepage of magenta dye from the squashed and broken magenta microcapsules 48M. Thus, the local spot is developed as a magenta dot on the second linear area of the microcapsule layer 44.

While the third linear area of the protective transparent film sheet 46 is scanned with the deflected infrared laser beam $LB_Y'$, the emission of the infrared laser beam $LB_Y'$ from the infrared laser source 60Y is controlled so as to be switched ON and OFF in accordance with a single-line of digital yellow image-pixel signals, in substantially the same manner as in a conventional laser printer. Namely, when one of the digital yellow image-pixel signals included in the single-line has a value [1], the emission of the infrared laser beam $LB_Y'$ from the infrared laser source 60Y is switched ON, but when one of the digital yellow image-pixel signals, included in the single-line, has a value [0], the emission of the infrared laser beam $LB_y'$ from the infrared laser source 60Y is switched OFF.

During the switching ON of the emission of the infrared laser beam $LB_Y'$ from the infrared laser source 60Y, a local spot on the third linear area of the protective transparent film sheet 46 is irradiated by the infrared laser beam $LB_Y'$ (778 $\mu$m), and is thermally heated to a temperature between the glass-transition temperatures $T_3$ and the upper limit temperature $T_{UL}$. Namely, by taking a scanning speed of the infrared laser beam $LB_Y'$ into account, the power of the infrared laser beam $LB_Y'$, which is higher than that of the infrared laser beam $LB_M'$, can be regulated so that a heating temperature of the local spot reaches the temperature between the glass-transition temperature $T_3$ and the upper limit temperature $T_{UL}$. Thus, only the yellow microcapsules 4BY encompassed by the irradiated local spot are squashed and broken, resulting in a seepage of yellow dye from the squashed and broken yellow microcapsules 48Y. Thus, the local spot is developed as a yellow dot on the third linear area of the microcapsule layer 44.

Thus, according to the above-mentioned color printer 50, it is possible to form a color image on the microcapsule layer 44 of the image-forming sheet 40 on the basis of the series of digital color image-pixel signals, i.e. digital cyan image-pixel signals, digital magenta image-pixel signals and digital yellow image-pixel signals.

In the color printer 50 shown in FIGS. 10 and 11, although the powers of the infrared laser beams $LB_C'$, $LB_M'$ and $LB_Y'$ are different from each other, so that selective squashing and breaking of the three types of cyan, magenta and yellow microcapsules 68C, 68M and 68Y occurs, the infrared laser beams $LB_C'$, $LB_M'$ and $LB_Y'$ may have the same power provided that respective durations of the ON-times of the emissions of the infrared laser beams ($LB_C'$, $LB_M'$ and $LB_Y'$) from the infrared laser sources (60C, 60M and 60Y) in response to values [1] of cyan, magenta and yellow digital image-pixel signals are different from each other.

Namely, the duration of the switching-ON of the emission of the infrared laser beam $LB_C'$ from the infrared laser source 60C should be shorter than the switching-ON duration of the emission of the infrared laser beam $LB_M'$ from the infrared laser source 60M, and the duration of the switching-ON of the emission of the infrared laser beam $LB_M'$ from the infrared laser source 60M should be shorter than the switching-ON duration of the emission of the infrared laser beam $LB_Y'$ from the infrared laser source 60Y, whereby the respective heating temperatures can be obtained, being between the glass-transition temperatures $T_1$ and $T_2$, between the glass-transition temperatures $T_2$ and $T_3$, and between the glass-transition temperature $T_3$ and the upper limit temperature $T_{UL}$, for production of cyan dots, magenta dots and yellow dots, respectively. In this case, of course, a scanning speed (i.e. a rotational speed of the polygon mirror assembly 62) is brought into line with the requirements of producing the yellow dots which need a maximum amount of thermal energy.

Figure 12:
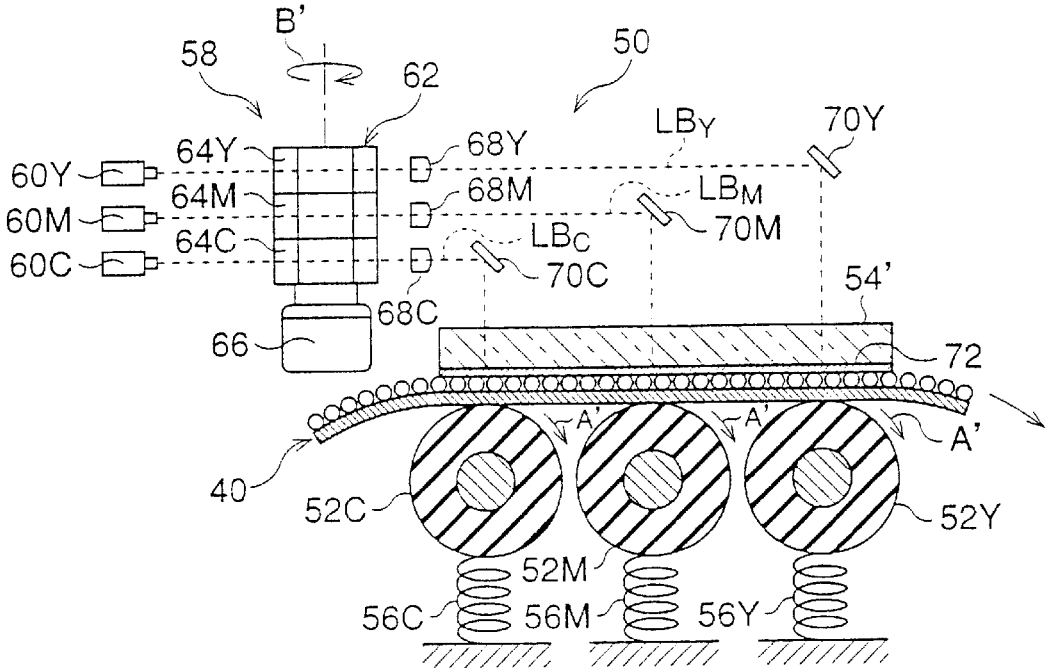
FIG. 12 is a schematic conceptual view, similar to FIG. 10, showing a modification of the color printer shown therein.

FIG. 12 shows a modification of the color printer shown in FIGS. 10 and 11. Note, in FIG. 12, the features similar to those of FIG. 10 are indicated by the same references. In this modified embodiment, a transparent glass plate 54' has an infrared absorbent layer 72 coated over a lower surface thereof, and the infrared absorbent layer 72 is formed of, for example, the above-mentioned product NK-2014, absorbing infrared rays having a wavelength of 778 $\mu$m.

Also, in an image-forming substrate 40 to be used in the modified color printer 50, a protective transparent film sheet 46 contains no infrared absorbent pigment (product NK-2014). Optionally, the protective transparent film sheet may be omitted from the image-forming substrate 40, as shown in FIG. 12.

Furthermore, in the modified embodiment shown in FIG. 12, for the infrared-absorbent layer 72, it is possible to utilize a black pigment coating layer effectively absorbing all infrared rays.

For a dye to be encapsulated in the microcapsules, leuco-pigment may be utilized. As is well-known, the leuco-pigment per se exhibits no color. Accordingly, in this case, color developer is contained in the binder, which forms a part of the layer of microcapsules (14, 44).

Also, a wax-type ink may be utilized for a dye to be encapsulated in the microcapsules. In this case, the wax-type ink should be thermally fused at less than a given temperature, as indicated by references $T_0$ and $T_1$.

Although all of the above-mentioned embodiments are directed to a formation of a color image, the present invention may be applied to a formation of a monochromatic image. In this case, a layer of microcapsules (14, 44) is composed of only one type of microcapsule filled with, for example, a black ink.

Further, in the above-mentioned embodiments, although infrared rays are utilized to selectively heat the three types of cyan, magenta and yellow microcapsules, any suitable type of electromagnetic radiation, such as ultraviolet rays, may be utilized for the selective heating of the three types of cyan, magenta and yellow microcapsules.

Finally, it will be understood by those skilled in the art that the foregoing description is of preferred embodiments of the device, and that various changes and modifications may be made to the present invention without departing from the spirit and scope thereof.

The present disclosure relates to subject matters contained in Japanese Patent Applications No. 10-12134 (filed on Jan. 6, 1998) and No. 10-12135 (filed on Jan. 6, 1998) which are expressly incorporated herein, by reference, in their entireties.

What is claimed is:

1. An image-forming system comprising:

an image-forming substrate including a base member, and a layer of microcapsules, coated over said base member, that contains at least one type of microcapsule filled with a dye, said at least one type of microcapsule exhibiting a pressure/temperature characteristic such that, when said at least one type of microcapsule is squashed and broken under a predetermined pressure at a predetermined temperature, said dye seeps from said squashed and broken microcapsule;

an image-forming apparatus that forms an image on said image-forming substrate, said image-forming apparatus including a pressure application unit that exerts said predetermined pressure on said layer of microcapsules, said pressure application unit including a transparent plate member, a layer of radiation absorbent material coated over a surface of said transparent plate member, and a platen member elastically pressed against said layer of radiation absorbent material at said predetermined pressure, with said image-forming substrate being interposed between said platen member and said layer of radiation absorbent material, said image-forming apparatus further including an irradiating unit that irradiates said layer of radiation absorbent material with a beam of radiation, such that a portion of said layer of microcapsules, encompassed by a local area of said layer of radiation absorbent material irradiated by said beam of radiation, is heated to said predetermined temperature.

2. An image-forming system as set forth in claim 1, wherein said at least one type of microcapsule has a shell wall composed of a resin which exhibits said pressure/temperature characteristic.

3. An image-forming system comprising:

an image-forming substrate including a base member, a layer of microcapsules, coated over said base member, that contains a first type of microcapsule filled with a first dye, and a second type of microcapsule filled with a second dye, said first type of microcapsule exhibiting a first pressure/temperature characteristic such that, when said first type of microcapsule is squashed and broken under a first predetermined pressure at a first predetermined temperature, said first dye seeps from said squashed and broken microcapsule, said second type of microcapsule exhibiting a second pressure/temperature characteristic such that, when said second type of microcapsule is squashed and broken under a second predetermined pressure at a second predetermined temperature, said second dye seeps from said squashed and broken microcapsule; and an image-forming apparatus that forms an image on said image-forming substrate, said image-forming apparatus including a pressure application unit that exerts said first-and second predetermined pressures on said layer of microcapsules, said pressure application unit including a transparent plate member, a layer of radiation absorbent material coated over a surface of said transparent plate member, a first platen member elastically pressed against said layer of radiation absorbent material at said first predetermined pressure, and a second platen member elastically pressed against said layer of radiation absorbent material at said second predetermined pressure, with said image-forming substrate being interposed between said first and second platen members and said layer of radiation absorbent material, said image-forming apparatus further including an irradiating unit that irradiates said layer of radiation absorbent material with a first beam of radiation and a second beam of radiation, such that two portions of said layer of microcapsules, encompassed by two local areas of said layer of radiation absorbent material irradiated by said first and second beams of radiation, are heated to said first and second predetermined temperatures.

4. An image-forming system as set forth in claim 3, wherein said respective first and second types of microcapsules have shell walls composed of resins which exhibit said first and second pressure/temperature characteristics.

* * * * *